US012111063B2

(12) United States Patent
Xing et al.

(10) Patent No.: US 12,111,063 B2
(45) Date of Patent: Oct. 8, 2024

(54) AIR INTAKE AND EXHAUST ASSEMBLY AND PACKAGED AIR CONDITIONER

(71) Applicant: GD MIDEA AIR-CONDITIONING EQUIPMENT CO., LTD., Foshan (CN)

(72) Inventors: Zhigang Xing, Foshan (CN); Eli Zhao, Foshan (CN)

(73) Assignee: GD MIDEA AIR-CONDITIONING EQUIPMENT CO., LTD., Foshan (CN)

( * ) Notice: Subject to any disclaimer, the term of this patent is extended or adjusted under 35 U.S.C. 154(b) by 362 days.

(21) Appl. No.: 17/430,223

(22) PCT Filed: Apr. 30, 2020

(86) PCT No.: PCT/CN2020/088359
§ 371 (c)(1),
(2) Date: Aug. 11, 2021

(87) PCT Pub. No.: WO2021/179422
PCT Pub. Date: Sep. 16, 2021

(65) Prior Publication Data

US 2022/0307702 A1 Sep. 29, 2022

(30) Foreign Application Priority Data

Mar. 10, 2020 (CN) ..... 202010162017.2
Mar. 10, 2020 (CN) ..... 202020289424.5

(51) Int. Cl.
*F24F 1/028* (2019.01)
*F24F 13/02* (2006.01)

(52) U.S. Cl.
CPC ..... *F24F 1/028* (2019.02); *F24F 13/0245* (2013.01)

(58) Field of Classification Search
CPC ..... F24F 1/028; F24F 1/031; F24F 2007/001; F24F 7/04; F24F 7/065; F24F 7/08;
(Continued)

(56) References Cited

U.S. PATENT DOCUMENTS 1,926,295 A * 9/1933 Martin ..... F24F 7/04 236/49.5
2,210,458 A 8/1940 Keilholtz
(Continued)

FOREIGN PATENT DOCUMENTS

CN 2211032 Y 10/1995
CN 2709847 Y 7/2005
(Continued)

OTHER PUBLICATIONS

World Intellectual Property Organization (WIPO) International Search Report and Written Opinion for PCT/CN2020/088359 Nov. 30, 2020 14 Pages (including translation).
(Continued)

*Primary Examiner* — Travis Ruby
(74) *Attorney, Agent, or Firm* — Anova Law Group, PLLC

(57) ABSTRACT

An air intake and exhaust assembly includes a first air pipe and a second air pipe. A first air duct is formed in the first air pipe and configured to be communicated with one of an air outlet of an air exhaust volute of an packaged air conditioner and an air inlet of the packaged air conditioner. The second air pipe is arranged adjacent to the first air pipe. A second air duct is formed between an inner wall of the second air pipe and an outer wall of the first air pipe. The second air duct is configured to be communicated with another one of the air outlet of the air exhaust volute and the air inlet of the packaged air conditioner. At least part of the
(Continued)

outer wall of the first air pipe along a length direction of the first air pipe is fixedly connected to the second air pipe.

13 Claims, 4 Drawing Sheets

(58) Field of Classification Search
CPC ..... F24F 13/0218; F24F 13/0245; F24F 1/04; F24F 2007/0025; F24F 13/0281
See application file for complete search history.

(56) References Cited

U.S. PATENT DOCUMENTS 2,959,196 A * 11/1960 Truesdell ..... F23J 13/04 285/402
3,208,236 A 9/1965 Frigerio
3,216,459 A * 11/1965 Schroeder ..... F16L 11/02 138/131
3,251,613 A * 5/1966 Tatsch ..... F24F 13/0209 285/49
3,478,667 A * 11/1969 Bourquin ..... F24F 13/0254 362/147
3,627,615 A * 12/1971 Guiles ..... B29C 63/065 156/203
3,857,590 A * 12/1974 Meeker ..... F16L 13/00 138/155
3,885,593 A * 5/1975 Koerber ..... B32B 27/06 138/131
4,867,232 A * 9/1989 Dewill ..... F24F 13/10 251/162
5,518,277 A * 5/1996 Sanders ..... F24F 13/0263 285/204
5,568,947 A 10/1996 Paquette
5,775,125 A * 7/1998 Sakai ..... F24F 11/74 62/262
6,370,906 B1 4/2002 Kuo
6,767,280 B1 * 7/2004 Berger ..... F24F 13/0218 454/339
2003/0207666 A1 * 11/2003 Crook ..... F24F 13/0209 454/292
2008/0054631 A1 * 3/2008 Gosis ..... B64F 1/362 138/119
2008/0211227 A1 * 9/2008 Ni ..... F24F 1/04 285/123.15
2016/0069586 A1 * 3/2016 Edgar ..... F24F 13/02 29/428

FOREIGN PATENT DOCUMENTS

| | | | |
|---|---|---|---|
| CN | 2779294 | Y | 5/2006 |
| CN | 2872166 | Y | 2/2007 |
| CN | 204830382 | U | 12/2015 |
| CN | 207132532 | U | 3/2018 |
| CN | 211822815 | U | 10/2020 |
| DE | 1454560 | A1 | 3/1969 |
| EP | 1715235 | A2 | 10/2006 |
| WO | 2015147728 | A1 | 10/2015 |

OTHER PUBLICATIONS

The European Patent Office (EPO) Extended Search Report for EP Application No. 20914757.8 Apr. 26, 2022 9 Pages.
The European Patent Office (EPO) Communication Pursuant to Article 94(3) EPC for EP Application No. 20914757.8 Mar. 15, 2024 5 Pages.
The China National Intellectual Property Administration (CNIPA) The First Office Action for Chinese Application 202010162017.2, May 31, 2024 10 Pages (With Translation).

* cited by examiner

AIR INTAKE AND EXHAUST ASSEMBLY AND PACKAGED AIR CONDITIONER

CROSS-REFERENCE TO RELATED APPLICATIONS

The present application is a National Stage Entry under 35 U.S.C. § 371 of International Application No. PCT/CN2020/088359, filed on Apr. 30, 2020, which claims priority to Chinese Application No. 202010162017.2, filed on Mar. 10, 2020 and entitled "AIR INTAKE AND EXHAUST ASSEMBLY AND PACKAGED AIR CONDITIONER," and Chinese Application No. 202020289424.5, filed on Mar. 10, 2020 and entitled "AIR INTAKE AND EXHAUST ASSEMBLY AND PACKAGED AIR CONDITIONER," the entire contents of all of which are incorporated herein by reference.

TECHNICAL FIELD

The present disclosure relates to the field of air-conditioning technologies, and more particularly, to an air intake and exhaust assembly and a packaged air conditioner.

BACKGROUND

In the related art, in an existing packaged air conditioner with dual air pipes, the dual air pipes include two independent air pipes, which are respectively used for connecting to an outdoor heat exchanger to realize air intake and connecting to an air exhaust volute to realize air exhaust, so that the packaged air conditioner can exchange heat with an outdoor environment. However, a dual-air-pipe structure is relatively complicated for a user to install, which results in poor user experience, and has an unsightly appearance.

SUMMARY

The present disclosure aims at solving at least one of the technical problems in the related art. Therefore, the present disclosure provides an air intake and exhaust assembly, which is stable in structure, and can avoid air shielding caused by distortion of a first air pipe in a second air pipe, so that air intake and exhaust are smoother.

The present disclosure also provides a packaged air conditioner including the air intake and exhaust assembly.

In accordance with a first aspect of the embodiments of the present disclosure, the air intake and exhaust assembly, applied to a packaged air conditioner having an air exhaust volute, includes: a first air pipe, where a first air duct is formed in the first air pipe, and the first air duct is communicated with one of an air outlet of the air exhaust volute and an air inlet of the packaged air conditioner; and a second air pipe, where the second air pipe sleeves the first air pipe, a second air duct is formed between an inner wall of the second air pipe and an outer wall of the first air pipe, and the second air duct is communicated with the other one of the air outlet of the air exhaust volute and the air inlet of the packaged air conditioner; where at least a part of the outer wall of the first air pipe along a length direction thereof is fixedly connected to the second air pipe.

The air intake and exhaust assembly according to the embodiments of the present disclosure has at least the following beneficial effects.

A dual-air-pipe structure is formed by arranging a first air pipe and a second air pipe sleeving the first air pipe, and at least a part of an outer wall of the first air pipe along a length direction thereof is fixedly connected to the second air pipe, so that a stable connection structure can be formed between the first air pipe and the second air pipe, thus avoiding air shielding caused by a distortion or displacement of the first air pipe in the second air pipe. Therefore, the air intake and exhaust of the packaged air conditioner can be smoother.

In accordance with some embodiments of the present disclosure, the part of the outer wall of the first air pipe along the length direction is attached to a part of the inner wall of the second air pipe and connected by a fixation member.

In accordance with some embodiments of the present disclosure, a plurality of fixation members are provided, and the plurality of fixation members are arranged at intervals along the length direction of the first air pipe.

In accordance with some embodiments of the present disclosure, a cross section of the second air pipe is oblong, a cross section of the first air pipe is round, two sides of the second air pipe along a front-rear direction are respectively attached to the outer wall of the first air pipe, and the fixation members are respectively arranged on the two sides of the second air pipe along the front-rear direction to fix the first air pipe in the second air pipe.

In accordance with some embodiments of the present disclosure, the second air pipe and the first air pipe are connected by a rivet.

In accordance with some embodiments of the present disclosure, the air intake and exhaust assembly also includes a first joint, where the first joint is fixedly connected to one end of the second air pipe, and the first joint is provided with a first through hole connected to the second air duct.

In accordance with some embodiments of the present disclosure, the air intake and exhaust assembly also includes a second joint, where the second joint is arranged in the first through hole and connected to the first joint, and the second joint is fixedly connected to one end of the first air pipe and provided with a second through hole connected to the first air duct.

In accordance with some embodiments of the present disclosure, a connection rib is arranged between the second joint and the first joint.

In accordance with some embodiments of the present disclosure, the first air pipe is a telescopic hose and at least a part of the first air pipe is made of a spiral iron wire.

In accordance with a second aspect of the embodiments of the present disclosure, the packaged air conditioner includes the air intake and exhaust assembly described in above embodiments.

The packaged air conditioner according to the embodiments of the present disclosure has at least the following beneficial effects.

A dual-air-pipe structure is formed by arranging a first air pipe and a second air pipe sleeving the first air pipe in the air intake and exhaust assembly, and at least a part of an outer wall of the first air pipe along a length direction thereof is fixedly connected to the second air pipe, so that a stable connection structure can be formed between the first air pipe and the second air pipe, thus avoiding air shielding caused by a distortion or displacement of the first air pipe in the second air pipe. Therefore, the air intake and exhaust of the packaged air conditioner can be smoother, and a heat exchange efficiency of a packaged air conditioner can thus be improved.

Additional aspects and advantages of the present disclosure will be explained in part in the following description, which can become apparent from the following description or be understood through practice of the present disclosure.

BRIEF DESCRIPTION OF DRAWINGS

The above and/or additional aspects and advantages of the present disclosure can become apparent and easy to understand from the description of embodiments in conjunction with the following drawings, where.

REFERENCE NUMERALS

Figure 1:
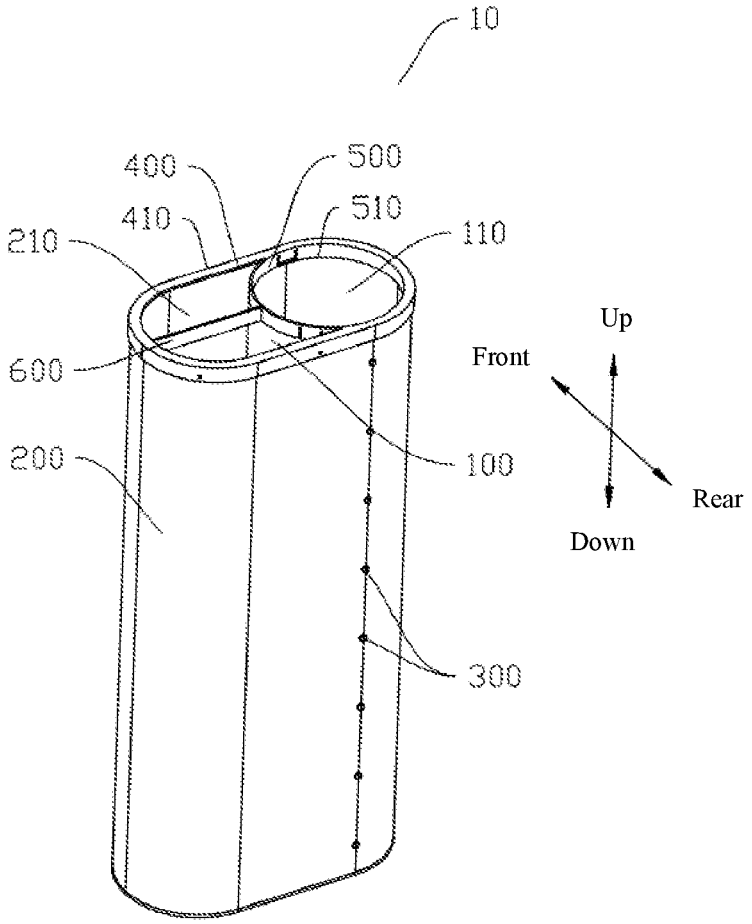
FIG. 1 is a three-dimensional structural diagram of an air intake and exhaust assembly according to an embodiment of the present disclosure.

10: air intake and exhaust assembly; 20: outdoor heat exchange assembly;
100: first air pipe; 110: first air duct;
200: second air pipe; 210: second air duct;
300: fixation member;
400: first joint; 410: first through hole;
500: second joint; 510: second through hole;
600: connection rib.

DETAILED DESCRIPTION

Embodiments of the present disclosure are described below in detail, illustrations of which are shown in the accompanying drawings, where identical or similar reference numerals denote identical or similar elements or elements having the same or similar functions. The embodiments described below by reference to the accompanying drawings are exemplary and are intended only to explain the present disclosure and are not to be construed as limiting the present disclosure.

In the description of the present disclosure, it should be understood that any orientation/position related description, such as the orientational or positional relationship, such as, up, down, left, right, front, rear, and the like, is based on the orientational or positional relationship shown in the accompanying drawings, is only for the purpose of facilitating the description of the present disclosure and simplifying the description, and does not indicate or imply that the device or element must have a specific orientation or position, be constructed and operated in a specific orientation or position, and therefore shall not be understood as a limitation to the present disclosure.

In the description of the present disclosure, a plurality of means more than two, and shall not be understood as indicating or implying relative importance or implying the number of indicated technical features or implying the order of indicated technical features.

In the description of the present disclosure, words such as setup, installation, and connection shall be understood in a broad sense unless otherwise expressly limited, and a person skilled in the art may reasonably determine the specific meaning of the above words in the present disclosure with reference to the context of the technical scheme.

Figure 2:
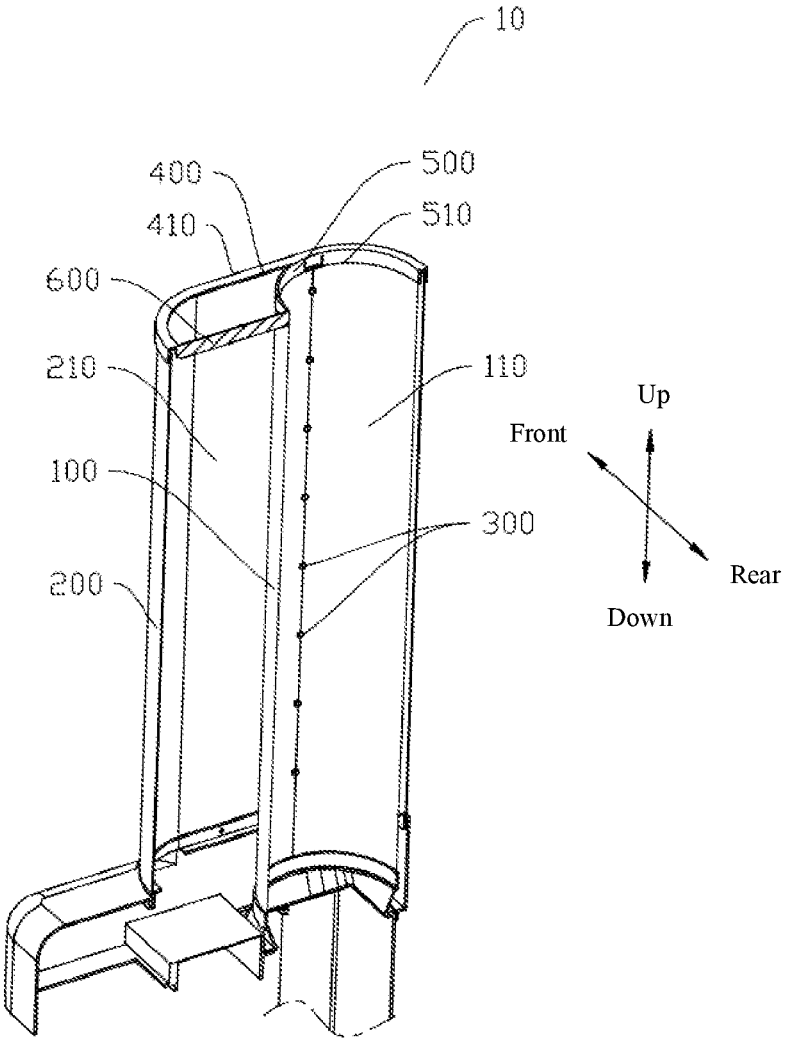
FIG. 2 is a cross-sectional view of the air intake and exhaust assembly according to an embodiment of the present disclosure.

With reference to FIG. 1 and FIG. 2, an air intake and exhaust assembly 10 according to an embodiment of the present disclosure includes a first air pipe 100 and a second air pipe 200, where a first air duct 110 is formed in the first air pipe 100, and the first air duct 110 is communicated with one of an air outlet of an air exhaust volute (not shown in the figures) and an air inlet of a packaged air conditioner (not shown in the figures), so that the first air duct 110 has a good sealing property, thus ensuring that air exhausted from the air exhaust volute can be completely exhausted outdoors through the first air duct 110, or outdoor air can be input to the air inlet of the packaged air conditioner. It is further illustrated that the second air pipe 200 sleeves the first air pipe 100, a second air duct 210 is formed between an inner wall of the second air pipe 200 and an outer wall of the first air pipe 100, and the second air duct 210 is communicated with the other one of the air outlet of the air exhaust volute and the air inlet of the packaged air conditioner, so that the second air duct 210 has a good sealing property, thus isolating the second air duct 210 from the first air duct 110, i.e., isolating the air intake from the air exhaust, which avoids heat exchange between the second air duct 210 and the first air duct 110 that affects a heat exchange efficiency of the packaged air conditioner. It may be understood that the first air duct 110 is communicated with the air exhaust volute for air exhaust, and the second air duct 210 is communicated with the air inlet of the packaged air conditioner for air intake. An installation structure of the air intake and exhaust assembly 10 of this embodiment is simpler and is more convenient to install. In addition, a dual-air-pipe structure is formed by arranging the first air pipe 100 and the second air pipe 200 sleeving the first air pipe 100. Compared with a dual-air-pipe structure composed of two separate independent air pipes, the air intake and exhaust assembly 10 of the embodiments of the present disclosure has a simple and aesthetical structure, which is convenient for users to install and adjust the dual-air-pipe structure, thus improving user experience. Moreover, the packaged air conditioner employing the dual-air-pipe structure can realize whole house cooling or heating, and improve the heat exchange efficiency of the packaged air conditioner.

With reference to FIG. 2, in the air intake and exhaust assembly 10 according to the embodiments of the present disclosure, at least a part of the outer wall of the first air pipe 100 along a length direction thereof is fixedly connected to the second air pipe 200. It may be understood that the length direction herein may be understood as the direction in which the first air pipe 100 extends during stretching adjustment. It should be noted that the fixed connection may be detachable manners by rivets, screws, etc., or fixing manners by hot melting, etc., which is not particularly limited here. The first air pipe 100 and the second air pipe 200 are fixedly connected along the length direction of the first air pipe 100 to form a stable connection structure, which avoids air shielding caused by distortion or displacement of the first air pipe 100 in the second air pipe 200, so that air intake and exhaust of the air intake and exhaust assembly 10 are smoother, thus improving a heat exchange effect between the packaged air conditioner and an outdoor environment.

With reference to FIG. 1 and FIG. 2, further, a part of the outer wall of the first air pipe 100 along the length direction thereof is attached to a part of the inner wall of the second air pipe 200 and connected by a fixation member 300. The fixation member 300 is configured to fix the first air pipe 100 with the second air pipe 200. It should be noted that the fixation member 300 may be a rivet or other connection member, which is not particularly limited here. In addition, a tensile strength of the air intake and exhaust assembly 10 is supported by the first air pipe 100, and the second air pipe 200 is fixedly connected to the outer wall of the first air pipe 100 through the fixation member 300, thus forming a stable connection structure, which is convenient to assemble, and avoids the air shielding caused by the distortion or displacement of the first air pipe 100 in the second air pipe 200, so that the air intake and exhaust of the air intake and exhaust assembly 10 are smoother, thus improving the heat exchange effect between the packaged air conditioner and the outdoor environment.

With reference to FIG. 1, in some embodiments of the present disclosure, a plurality of fixation members 300 are provided, and the plurality of fixation members 300 are arranged at intervals along the length direction of the first air pipe 100. The plurality of fixation members 300 respectively fix the second air pipe 200 and the first air pipe 100 along the length direction of the first air pipe 100, i.e., a direction along which the first air pipe 100 extends, which ensures that each section of the first air pipe 100 and the second air pipe 200 can be stably connected, so that the structure of the air intake and exhaust assembly 10 is more stable when being installed and used, and avoids the air shielding caused by distortion of a part of the first air pipe 100 in the second air pipe 200 that affects air intake and exhaust effects of the air intake and exhaust assembly 10. In addition, it may be understood that in this embodiment, the first air pipe 100 and the second air pipe 200 can be integrally stretched and contracted through the structure of the plurality of fixation members 300, which improves an efficiency of installation and disassembly of the air intake and exhaust assembly 10 and improves a usability of users.

With reference to FIG. 1 and FIG. 2, in some embodiments of the present disclosure, a cross section of the second air pipe 200 is oblong, a cross section of the first air pipe 100 is round, two sides of the second air pipe 200 along a front-rear direction thereof are respectively attached to the outer wall of the first air pipe 100, and the fixation members 300 are respectively arranged on the two sides of the second air pipe 200 along the front-rear direction to fix the first air pipe 100 in the second air pipe 200, so that the second air pipe 200 and the first air pipe 100 are connected firmly, and are not easy to be loose, thus prolonging a service life of the air intake and exhaust assembly 10.

It should be noted that oblong may be defined as: a figure formed by selecting two points on the same diameter of a circle or two arcs symmetrical about a center of the circle and stretching the circle along a straight line or an arc. For example, an oblong shape may be a runway shape formed by a cross section of the second air pipe 200 as shown in FIG. 1. Of course, the oblong shape may also be an oval or a square with rounded corners. The second air pipe 200 employs an oblong structure, which can reduce the size of the air intake and exhaust assembly 10 along the front-rear direction with an equivalent air intake area, so that an appearance of the packaged air conditioner may be more aesthetically favorable. The first air pipe 100 employs a round structure, and a structural strength of the first air pipe 100 after stretching can be improved by adopting a structural design of a spiral iron wire, so that the first air pipe 100 has a supporting function, overcomes the defects that the second air pipe 200 has poor strength and is difficult to shape after stretching due to the limitation of a processing technology, and makes an overall structure of the air intake and exhaust assembly 10 more stable.

In addition, through the shape design of the cross sections of the second air pipe 200 and the first air pipe 100, a contact area between the second air pipe 200 and the first air pipe 100 is larger, which facilitates the arrangement and installation of the fixation member 300, makes the overall structure more stable, and improves a tensile strength of the air intake and exhaust assembly 10. Further, the plurality of fixation members 300 form a group along the front-rear direction respectively, and each group of fixation members 300 is arranged at intervals along the length direction of the first air pipe 100 or the length direction of the second air pipe 200, which further improves a connection stability between each section of the first air pipe 100 and the second air pipe 200, makes the structure of the air intake and exhaust assembly 10 more stable when being installed and used, and avoids the distortion of a part of the first air pipe 100 in the second air pipe 200 that affects the air intake and exhaust effects of the air intake and exhaust assembly 10.

In some embodiments of the present disclosure, the second air pipe 200 and the first air pipe 100 are connected by rivets, which are convenient to assemble, stable in structure and low in production cost.

In some embodiments of the present disclosure, as shown in FIG. 1 and FIG. 2, the air intake and exhaust assembly 10 of this embodiment also includes a first joint 400, where the first joint 400 is fixedly connected to one end of the second air pipe 200, and the first joint 400 is provided with a first through hole 410 connected to the second air duct 210. The first through hole 410 allows outdoor air to enter the second air duct 210, so that a user can realize synchronous operation of the second air pipe 200 by operating the first joint 400, which is convenient for stretching and installing or contracting and folding of the second air pipe 200, and improves a usability of the second air pipe 200. In addition, it is also convenient for the user to stretch or fold the first air pipe 100 through the first through hole 410.

In some embodiments of the present disclosure, a second joint 500 is also included, where the second joint 500 is arranged in the first through hole 410 and connected to the first joint 400, so that the second joint 500 and the first joint 400 are constructed as a whole. The second joint 500 is fixedly connected to one end of the first air pipe 100 and provided with a second through hole 510 connected to the first air duct 110. The second through hole 510 allows the air in the first air duct 110 to be discharged to the outdoor environment, and the first air pipe 100 and the second air pipe 200 can be simultaneously stretched and installed or contracted and folded. In addition, the first joint 400 may be installed on a sealing plate, which is convenient for the user to integrally stretch and contract the air intake and exhaust assembly 10, and install or disassemble the air intake and exhaust assembly 10 on a window, thus improving the efficiency of installation and disassembly of the air intake and exhaust assembly 10 and further improving the usability of the air intake and exhaust assembly 10. Further, the second joint 500 and the first joint 400 may be formed by integral injection molding, and are more convenient to process and more stable in structure.

In some embodiments of the present disclosure, a connection rib 600 is arranged between the second joint 500 and the first joint 400. Two ends of the connection rib 600 are fixedly connected to opposite ends of the second joint 500 and the first joint 400, which increases an overall strength of the second joint 500 and the first joint 400, and makes the air intake and exhaust assembly 10 more stable during installation or disassembly operations.

In some embodiments of the present disclosure, the first air pipe 100 is a telescopic hose, at least a part of which is made of a spiral iron wire, which improves the tensile strength of the first air pipe 100 and is easy to shape, so that the tensile strength of the air intake and exhaust assembly 10 is supported by the first air pipe 100, and a part of the second air pipe 200 is wrapping and attached to an outside of the first air pipe 100, thus forming a stable connection structure, which avoids air shielding caused by distortion or displacement of the first air pipe 100 in the second air pipe 200, so that the air intake and exhaust of the air intake and exhaust assembly 10 are smoother, which further improves the heat exchange effect between the packaged air conditioner and the outdoor environment. Further, a body of the telescopic hose is made of plastic, which has good flexibility, light weight, and good durability, and is convenient to contract and fold.

In some embodiments of the present disclosure, the second air pipe 200 is a telescopic hose, at least a part of which is made of plastic or canvas material, which may be conveniently installed and fixed on the outer wall of the first air pipe 100, and has good flexibility and good durability, and is convenient to contract and fold. In addition, the telescopic hose is embedded with a barbed wire framework, which has a certain shaping effect when being connected to the first air pipe 100, thus improving the strength of the air intake and exhaust assembly 10.

Figure 3:
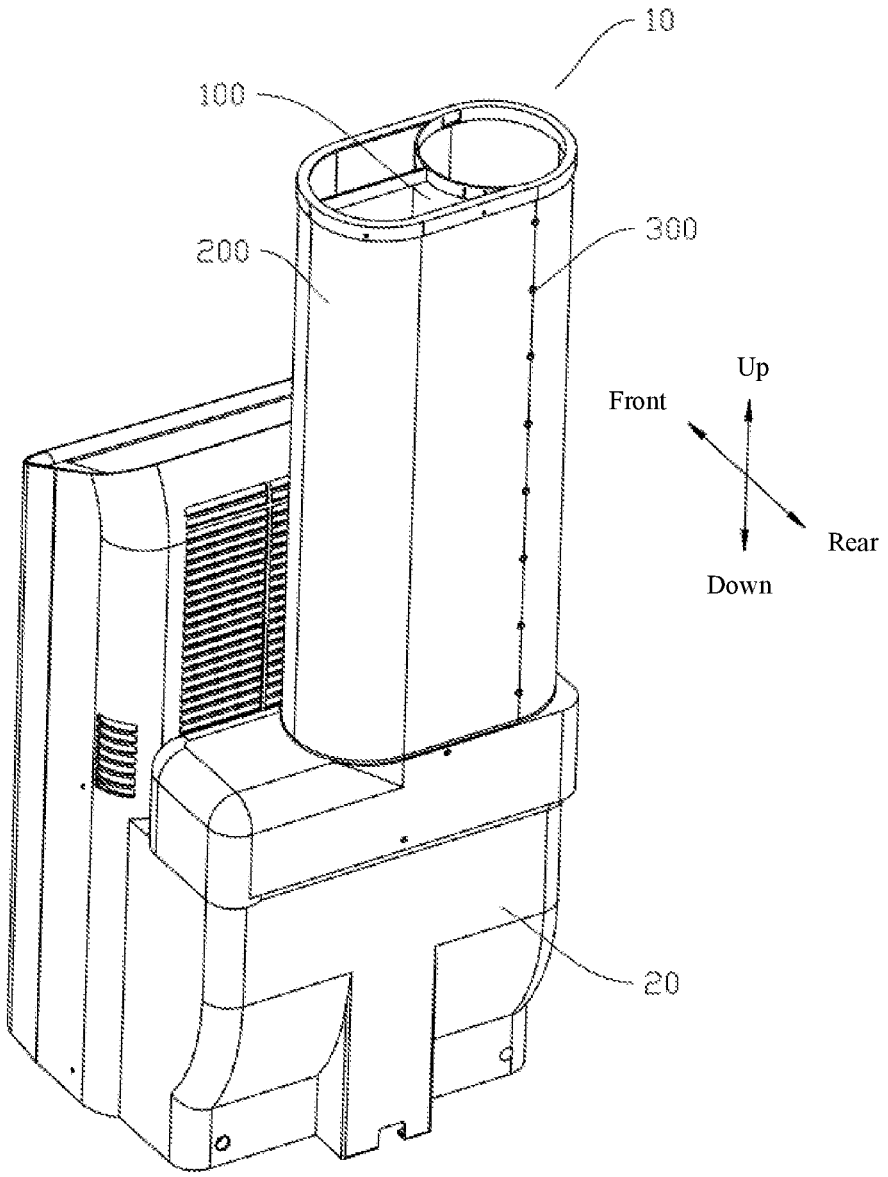
FIG. 3 is a three-dimensional structural diagram of a packaged air conditioner according to an embodiment of the present disclosure.
Figure 4:
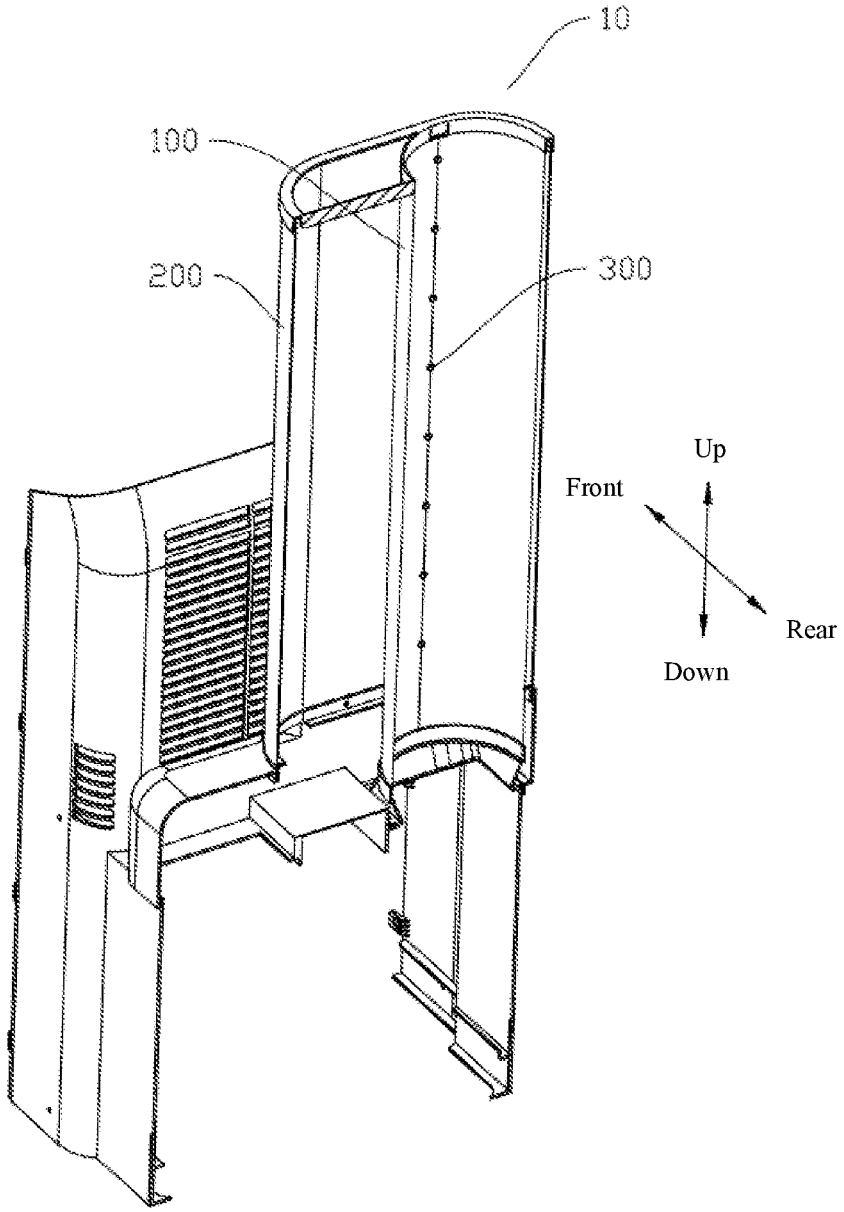
FIG. 4 is a cross-sectional view of FIG. 3.

With reference to FIG. 3 and FIG. 4, a packaged air conditioner according to an embodiment of the present disclosure is a packaged air conditioner with a dual-air-pipe structure, including the air intake and exhaust assembly 10 according to the embodiments above, where the air intake and exhaust assembly 10 is connected to an outdoor heat exchange assembly of the packaged air conditioner. The outdoor heat exchange assembly 20 includes an outdoor heat exchanger (not shown in the figures) and an air exhaust volute (not shown in the figures). One air pipe of the air intake and exhaust assembly 10 guides outdoor air to enter from an air inlet of the packaged air conditioner. After the air exchanges heat through an outdoor heat exchanger, the air after heat exchange is discharged to the outdoor through the other air pipe of the air intake and exhaust assembly 10 by the air exhaust volute, thus realizing a heat exchange process of the packaged air conditioner. The packaged air conditioner of this embodiment is formed with the dual-air-pipe structure by arranging the first air pipe 100 and the second air pipe 200 sleeving the first air pipe 100 in the air intake and exhaust assembly 10, and at least a part of an outer wall of the first air pipe 100 along the length direction is fixedly connected to the second air pipe 200, so that a stable connection structure is formed between first air pipe 100 and the second air pipe 200, thus avoiding air shielding caused by distortion or displacement of the first air pipe 100 in the second air pipe 200, so that the air intake and exhaust of the packaged air conditioner are smoother, thus improving a heat exchange efficiency of the packaged air conditioner.

The embodiments of the present disclosure have been described in detail above with reference to the accompanying drawings, but the present disclosure is not limited to the embodiments described above, and various changes may be made without departing from the spirits of the present disclosure within the scope of knowledge possessed by those of ordinary skill in the art.

The invention claimed is:

1. An air intake and exhaust assembly comprising:

a first air pipe, a first air duct being formed in the first air pipe and configured to be communicated with one of an air outlet of an air exhaust volute of a packaged air conditioner and an air inlet of the packaged air conditioner, the first air pipe including a first telescopic hose;

a second air pipe arranged adjacent to the first air pipe, a second air duct being formed between an inner wall of the second air pipe and an outer wall of the first air pipe, and the second air duct being configured to be communicated with another one of the air outlet of the air exhaust volute and the air inlet of the packaged air conditioner, the second air pipe including a second telescopic hose, the second telescopic hose being different from the first telescopic hose, and the second air pipe and the first air pipe being configured to be stretched or contracted simultaneously;

a first joint fixedly connected to one end of the second air pipe, the first joint being provided with a through hole connected to the second air duct;

a second joint arranged in the first through hole and connected to the first joint, the second joint being fixedly connected to one end of the first air pipe and provided with a second through hole connected to the first air duct; and a connection rib connecting the second joint and the first joint, the connection rib dividing the first through hole into two equal portions;

wherein at least part of the outer wall of the first air pipe along a length direction of the first air pipe is fixedly connected to the second air pipe.

2. The air intake and exhaust assembly according to claim 1, wherein the at least part of the outer wall of the first air pipe is connected to a part of the inner wall of the second air pipe by a fixation member.

3. The air intake and exhaust assembly according to claim 2, wherein:

the fixation member is one of a plurality of fixation members connecting the at least part of the outer wall of the first air pipe and the part of the inner wall of the second air pipe; and the plurality of fixation members are arranged at intervals along the length direction of the first air pipe.

4. The air intake and exhaust assembly according to claim 3, wherein:

a cross section of the second air pipe is oblong;

a cross section of the first air pipe is round;

two sides of the second air pipe along a front-rear direction are attached to the outer wall of the first air pipe; and the plurality of fixation members are arranged on the two sides of the second air pipe along the front-rear direction to fix the first air pipe in the second air pipe.

5. The air intake and exhaust assembly according to claim 2, wherein the fixation member includes a rivet.

6. The air intake and exhaust assembly according to claim 1, wherein the first telescopic hose is at least partially made of a spiral iron wire.

7. A packaged air conditioner comprising:

an air inlet;

an air exhaust volute; and an air intake and exhaust assembly including:

a first air pipe, a first air duct being formed in the first air pipe and configured to be communicated with one of an air outlet of the air exhaust volute and the air inlet, the first air pipe including a first telescopic hose; and a second air pipe arranged adjacent to the first air pipe, a second air duct being formed between an inner wall of the second air pipe and an outer wall of the first air pipe, and the second air duct being configured to be communicated with another one of the air outlet of the air exhaust volute and the air inlet, the second air pipe including a second telescopic hose, the second telescopic hose being different from the first telescopic hose, and the second air pipe and the first air pipe being configured to be stretched or contracted simultaneously;

a first joint fixedly connected to one end of the second air pipe, the first joint being provided with a through hole connected to the second air duct;

a second joint arranged in the first through hole and connected to the first joint, the second joint being fixedly connected to one end of the first air pipe and provided with a second through hole connected to the first air duct; and a connection rib connecting the second joint and the first joint, the connection rib dividing the first through hole into two equal portions;

wherein at least part of the outer wall of the first air pipe along a length direction of the first air pipe is fixedly connected to the second air pipe.

8. The packaged air conditioner according to claim 7, wherein the at least part of the outer wall of the first air pipe is connected to a part of the inner wall of the second air pipe by a fixation member.

9. The packaged air conditioner according to claim 8, wherein:

the fixation member is one of a plurality of fixation members connecting the at least part of the outer wall of the first air pipe and the part of the inner wall of the second air pipe; and the plurality of fixation members are arranged at intervals along the length direction of the first air pipe.

10. The packaged air conditioner according to claim 9, wherein:

a cross section of the second air pipe is oblong;

a cross section of the first air pipe is round;

two sides of the second air pipe along a front-rear direction are attached to the outer wall of the first air pipe; and the plurality of fixation members are arranged on the two sides of the second air pipe along the front-rear direction to fix the first air pipe in the second air pipe.

11. The packaged air conditioner according to claim 8, wherein the fixation member includes a rivet.

12. The packaged air conditioner according to claim 7, wherein the first telescopic hose is at least partially made of a spiral iron wire.

13. An air intake and exhaust assembly comprising:

a first air pipe, a first air duct being formed in the first air pipe and configured to be communicated with one of an air outlet of an air exhaust volute of a packaged air conditioner and an air inlet of the packaged air conditioner, and a cross section of the first air pipe is round, the first air pipe including a first telescopic hose; and a second air pipe arranged adjacent to the first air pipe, a second air duct being formed between an inner wall of the second air pipe and an outer wall of the first air pipe, and the second air duct being configured to be communicated with another one of the air outlet of the air exhaust volute and the air inlet of the packaged air conditioner, and a cross section of the second air pipe being oblong, the second air pipe including a second telescopic hose, the second telescopic hose being different from the first telescopic hose, and the second air pipe and the first air pipe being configured to be stretched or contracted simultaneously;

wherein:

at least part of the outer wall of the first air pipe along a length direction of the first air pipe is fixedly connected to the second air pipe;

two sides of the second air pipe along a front-rear direction are attached to the outer wall of the first air pipe; and the outer wall of the first air pipe is connected to the inner wall of the second air pipe by two groups of fixation members, each of the two group of fixation members being arranged along the length direction of the first air pipe, the two groups of fixation members being at two opposite sides of the first pipe, respectively, and the two opposite sides of the first piper being at two ends of a diameter of the first pipe, respectively.

* * * * *